US012203226B2

(12) United States Patent
Ramseger

(10) Patent No.: US 12,203,226 B2
(45) Date of Patent: Jan. 21, 2025

(54) DOWEL BAR INSERTER

(71) Applicant: Wirtgen GmbH, Windhagen (DE)

(72) Inventor: Gunnar Ramseger, Borod (DE)

(73) Assignee: Wirtgen GmbH, Windhagen (DE)

( * ) Notice: Subject to any disclaimer, the term of this patent is extended or adjusted under 35 U.S.C. 154(b) by 448 days.

(21) Appl. No.: 17/555,568

(22) Filed: Dec. 20, 2021

(65) Prior Publication Data

US 2023/0193570 A1 Jun. 22, 2023

(51) Int. Cl.
*E01C 23/04* (2006.01)

(52) U.S. Cl.
CPC ..... *E01C 23/04* (2013.01)

(58) Field of Classification Search
CPC ..... E01C 23/04
See application file for complete search history.

(56) References Cited

U.S. PATENT DOCUMENTS 3,605,579 A 9/1971 Heltzel
3,850,541 A 11/1974 Baillet et al.
4,798,495 A * 1/1989 Laeuppi ..... E01C 23/04 404/100
5,101,360 A 3/1992 Bennett
5,190,397 A * 3/1993 Bengford ..... E01C 23/04 404/72
5,209,602 A 5/1993 Godbersen
5,405,212 A 4/1995 Swisher et al.
5,529,434 A * 6/1996 Swisher, Jr. ..... E01C 19/48 404/108
5,568,992 A 10/1996 Grembowicz et al.
(Continued)

FOREIGN PATENT DOCUMENTS

EP 3763877 A1 1/2021
EP 3832016 A1 6/2021
(Continued)

OTHER PUBLICATIONS

D. Castro-Lacourute and L. S. Bryson, C. Maynard, R. L. Williams, II and P. Bosscher, Concrete Paving Productivity Improvement Using a Multi-Task Autonomous Robot, 24th International Symposium on Automation & Robotics in Construction (ISARC 2007) Construction Automation Group, I.I.T. Madras, 7 pages.
(Continued)

*Primary Examiner* — Abigail A Risic
(74) *Attorney, Agent, or Firm* — Lucian Wayne Beavers; Patterson Intellectual Property Law, PC

(57) ABSTRACT

A dowel bar inserter includes first and second end carriages, a bottom pan assembly configured to engage a top surface of a concrete slab, an insertion beam, and a plurality of insertion forks attached to the insertion beam. First and second insertion actuators support the insertion beam from the first and second end carriages. First and second end suspension actuators support the bottom pan assembly from the end carriages independent of the raising and lowering of the insertion beam relative to the end carriages. Each of the suspension actuators includes associated therewith a suspension actuator extension sensor configured to detect an amount of extension of the respective suspension actuator.

29 Claims, 11 Drawing Sheets

(56) References Cited

U.S. PATENT DOCUMENTS

| | | | | |
|---|---|---|---|---|
| 5,588,776 | A * | 12/1996 | Swisher, Jr | E01C 23/04 404/101 |
| 5,924,817 | A | 7/1999 | Godbersen | |
| 5,941,659 | A * | 8/1999 | Godbersen | E01C 23/04 404/100 |
| 6,176,643 | B1 | 1/2001 | Guntert et al. | |
| 6,390,726 | B1 | 5/2002 | Guntert et al. | |
| 6,390,727 | B1 | 5/2002 | Guntert et al. | |
| 6,390,728 | B1 * | 5/2002 | Casters | E01C 23/04 404/100 |
| 6,597,037 | B1 | 7/2003 | Forbes et al. | |
| 6,655,869 | B1 | 12/2003 | Deeb et al. | |
| 7,037,035 | B2 | 5/2006 | Casters | |
| 7,136,522 | B2 | 11/2006 | Harrington et al. | |
| 8,382,396 | B2 | 2/2013 | Francis et al. | |
| 8,613,566 | B2 | 12/2013 | Fritz et al. | |
| 8,989,968 | B2 | 3/2015 | Fritz et al. | |
| 9,039,322 | B2 | 5/2015 | Francis et al. | |
| 9,051,696 | B1 | 6/2015 | Coats et al. | |
| 9,096,977 | B2 | 8/2015 | Fritz et al. | |
| 9,359,726 | B2 | 6/2016 | Francis et al. | |
| 9,395,726 | B1 | 7/2016 | Rizzi et al. | |
| 9,404,228 | B1 | 8/2016 | Coats et al. | |
| 9,551,115 | B2 | 1/2017 | Engels et al. | |
| 10,132,046 | B2 | 11/2018 | Thieme et al. | |
| 10,253,461 | B2 | 4/2019 | Engels et al. | |
| 10,738,421 | B2 | 8/2020 | Guntert, Jr. et al. | |
| 11,193,244 | B2 | 12/2021 | Guntert, Jr. et al. | |
| 2001/0041094 | A1 * | 11/2001 | Guntert, Jr. | E01C 23/04 404/105 |
| 2006/0204334 | A1 | 9/2006 | Guntert et al. | |
| 2010/0150650 | A1 | 6/2010 | Buschmann et al. | |
| 2011/0058899 | A1 * | 3/2011 | Francis | E01C 23/04 404/88 |
| 2016/0115654 | A1 | 4/2016 | Pedersen et al. | |
| 2016/0177519 | A1 | 6/2016 | Fritz et al. | |
| 2017/0073907 | A1 * | 3/2017 | Jennings | E01C 19/42 |
| 2019/0203428 | A1 * | 7/2019 | Guntert, Jr. | E01C 11/14 |
| 2021/0172129 | A1 | 6/2021 | Wenzelmann | |

FOREIGN PATENT DOCUMENTS

| | | | |
|---|---|---|---|
| EP | 3845709 | A1 | 7/2021 |
| EP | 3865625 | A2 | 8/2021 |

OTHER PUBLICATIONS

International Search Report and Written Opinion for corresponding patent application No. PCT/EP2022/085911, dated May 9, 2023, 16 pages (not prior art).

European Search Report and Written Opinion for corresponding patent application No. 22211870.5, dated May 8, 2023, 9 pages (not prior art).

* cited by examiner

DOWEL BAR INSERTER

FIELD OF THE DISCLOSURE

The present disclosure relates to a dowel bar inserter apparatus for inserting dowel bars in a freshly placed concrete slab, and to methods of operation of such an apparatus.

BACKGROUND

A dowel bar inserter apparatus includes a bottom pan assembly, sometimes referred to as a bottom-group assembly. The bottom pan assembly is the structure that slides across the top of the freshly placed concrete slab, and from which the dowel bars are inserted into the concrete slab. Modern slip form pavers and the associated dowel bar inserters must span large widths, up to as much as 50 feet. To insure that the bottom pan assembly properly glides over the top surface of the concrete slab, and does not dig into the slab, the bottom pan assembly is supported from the structure of the dowel bar inserter which in turn is typically supported from the main frame of the associated slip form paver. This support is typically proved by a series of threaded rods which must be manually adjusted during the set-up of the dowel bar inserter for a given paving job. If height corrections of the bottom pan assembly are necessary during the paving operation, again these adjustments are typically made by further manual adjustment of the threaded support rods.

Such height corrections of the bottom pan assembly are often necessitated by changes which may occur in the consistency of the concrete during the paving operation. Such changes in consistency may occur across the working width of the dowel bar inserter and/or in the paving direction. When such manual corrections of the height of the bottom pan assembly are needed they often can only be carried out by a human operator stepping onto the freshly paved concrete surface to adjust the threaded support rods, and access to those mechanical components is often difficult. But it is very undesirable for the operator to step onto the concrete surface because that may influence the position of dowel bars that have already been inserted.

There is a need for improved dowel bar inserters that avoid the need for such manual height adjustments of the bottom pan assembly.

SUMMARY OF THE DISCLOSURE

In one embodiment a dowel bar inserter apparatus includes first and second end carriages, a bottom pan assembly configured to engage a top surface of a freshly placed concrete slab, an insertion beam having a plurality of insertion forks attached to the insertion beam, and first and second insertion actuators supporting the insertion beam from the first and second end carriages, respectively, for raising and lowering the insertion beam and the insertion forks relative to the end carriages. At least one first suspension actuator supports the bottom pan assembly from the first end carriage independent of the raising and lowering of the insertion beam relative to the first end carriage. At least one second suspension actuator supports the bottom pan assembly from the second end carriage independent of the raising and lowering of the insertion beam relative to the second end carriage. Each of the suspension actuators includes associated therewith a suspension actuator extension sensor configured to detect an amount of extension of the respective suspension actuator.

The at least one first end suspension actuator may include a forward first end suspension actuator and a rear first end suspension actuator. The at least one second end suspension actuator may include a forward second end suspension actuator and a rear second end suspension actuator.

In any of the above embodiments each of the suspension actuators may be a hydraulic cylinder.

In any of the above embodiments each of the suspension actuators may comprise a hydraulic smart cylinder, and the suspension actuator extension sensor associated with each suspension actuator may be an integral part of the hydraulic smart cylinder.

In any of the above embodiments the dowel bar inserter may include a plurality of deflection compensation actuators configured to support a plurality of intermediate locations of the bottom pan assembly, the deflection compensation actuators being located between the first and second suspension actuators.

In any of the above embodiments each of the deflection compensation actuators may include a hydraulic cylinder and a flexible connector connecting the hydraulic cylinder to the bottom pan assembly such that the deflection compensation actuators can support the bottom pan assembly in tension loading but not compression loading of the flexible connectors.

In any of the above embodiments each of the hydraulic cylinders of the deflection compensation actuators may comprise a hydraulic smart cylinder including an integral deflection compensation actuator extension sensor.

In any of the above embodiments each of the deflection compensation actuators may be connected to the insertion beam so that the plurality of intermediate locations of the bottom pan assembly are supported from the insertion beam.

In any of the above embodiments each of the deflection compensation actuators may be connected to a support structure fixed to the first and second end carriages so that the plurality of intermediate locations of the bottom pan assembly are supported from the support structure.

In any of the above embodiments the deflection compensation actuators may be arranged in pairs of deflection compensation actuators, each pair including a front deflection compensation actuator and a rear deflection compensation actuator.

In any of the above embodiments the dowel bar inserter may include a chain conveyor configured to carry dowel bars to the bottom pan assembly and a hydraulic chain tensioning cylinder configured to maintain a tension in the chain conveyor.

In any of the above embodiments each of the suspension actuator extension sensors may be configured to generate a suspension actuator extension signal corresponding to the amount of extension of the respective suspension actuator, and the dowel bar inserter may further include a controller configured to receive the suspension actuator extension signals and to send control signals to the respective suspension actuators, at least in part in response to the suspension actuator extension signals for the respective suspension actuators.

In any of the above embodiments the dowel bar inserter may include a plurality of deflection compensation actuators configured to support a plurality of intermediate locations of the bottom pan assembly from the insertion beam, each of the deflection compensation actuators including a hydraulic smart cylinder including an integral deflection compensation actuator extension sensor, and the controller may be further configured to receive deflection compensation actuator extension signals from the deflection compensation actuator extension sensors corresponding to an extension of the respective deflection compensation actuators, and to send control signals to the respective deflection compensation actuators, at least in part in response to the deflection compensation actuator extension signals for the respective deflection compensation actuators.

In any of the above embodiments the dowel bar inserter may include at least one dowel bar storage bin located above the first end carriage, a chain conveyor configured to carry dowel bars from the at least one dowel bar storage bin to the bottom pan assembly, and an adjustable height support supporting the at least one dowel bar storage bin at an adjustable height above the first end carriage such that adjustment of the height of the at least one dowel bar storage bin above the first end carriage provides an initial adjustment of a chain tension in the chain conveyor during setup of the dowel bar inserter apparatus.

In any of the above embodiments the dowel bar inserter may include at least one hydraulic chain tensioning cylinder or other tensioning device extending between the first end carriage and the chain conveyor and configured to provide a further adjustment of chain tension in the chain conveyor during operation of the dowel bar inserter apparatus. Similar hydraulic chain tensioning cylinders may extend between the second end carriage and the chain conveyor.

In any of the above embodiments the dowel bar inserter may include at least one chain conveyor configured to carry dowel bars to the bottom pan assembly, a chain tensioning actuator configured to maintain a tension in the chain conveyor, a chain tensioning sensor, and a controller configured to receive a chain tension signal from the chain tensioning sensor and to send a control signal to the chain tensioning actuator, at least in part in response to the chain tension signal.

In any of the above embodiments the at least one first end suspension actuator may include a forward first end suspension actuator and a rear first end suspension actuator, and the at least one second end suspension actuator may include a forward second end suspension actuator and a rear second end suspension actuator. The controller may be configured to adjust the amount of extension of the forward first end suspension actuator and the forward second end suspension actuator relative to the amount of extension of the rear first end suspension actuator and the rear second end suspension actuator, respectively, to adjust a front to rear slope of the bottom pan assembly.

In any of the above embodiments the dowel bar inserter may include a plurality of deflection compensation actuators configured to support a plurality of intermediate locations of the bottom pan assembly, the deflection compensation actuators being located between the first and second suspension actuators, the deflection compensation actuators being arranged in pairs of deflection compensation actuators, each pair including a front deflection compensation actuator and a rear deflection compensation actuator, and the controller may be further configured to adjust an amount of extension of the front deflection compensation actuators relative to an amount of extension of the rear deflection compensation actuators to adjust the front to rear slope of the bottom pan assembly.

In any of the above embodiments the dowel bar inserter may include a swelling sensor configured to detect a swelling of the concrete slab and the controller may be configured to receive a signal from the swelling sensor corresponding to the swelling of the concrete slab, and to adjust the front to rear slope of the bottom pan assembly at least in part in response to the signal from the swelling sensor. The swelling sensor may be mounted on the dowel bar inserter itself or it may be mounted on other associated structures such as the paving mold which is a part of the paving apparatus located ahead of the dowel bar inserter.

In any of the above embodiments the controller may be further configured to adjust all of the suspension actuators to raise the entire bottom pan assembly at least in part in response to the signal from the swelling sensor.

In any of the above embodiments the controller may be configured to have a transport mode in which all of the suspension actuators are adjusted to raise the bottom pan assembly to a transport position.

A method of operating the dowel bar inserter of any of the above embodiments may include steps of:

receiving suspension actuator extension signals from the suspension actuator extension sensors with a controller; and sending control signals from the controller to the suspension actuators at least in part in response to the suspension actuator extension signals for the respective suspension actuators.

The above method may further include:

receiving deflection compensation actuator extension signals from the deflection compensation actuator extension sensors corresponding to an extension of the respective deflection compensation actuators; and sending control signals to the respective deflection compensation actuators, at least in part in response to the deflection compensation actuator extension signals for the respective deflection compensation actuators.

Any of the above methods may further include:

receiving a chain tension signal from the chain tensioning sensor with the controller; and sending a control signal from the controller to the chain tensioning actuator, at least in part in response to the chain tension signal.

Any of the above methods may further include:

sending control signals from the controller to adjust the amount of extension of the forward first end suspension actuator and the forward second end suspension actuator relative to the amount of extension of the rear first end suspension actuator and the rear second end suspension actuator, respectively, thereby adjusting a front to rear slope of the bottom pan assembly.

Any of the above methods may further include:

sending control signals from the controller to adjust an amount of extension of the front deflection compensation actuators relative to an amount of extension of the rear deflection compensation actuators to adjust the front to rear slope of the bottom pan assembly.

Any of the above methods may further include:

detecting a swelling of the concrete slab with a swelling sensor;

receiving with the controller a signal from the swelling sensor corresponding to the swelling of the concrete slab; and sending control signals from the controller to adjust the front to rear slope of the bottom pan assembly at least in part in response to the signal from the swelling sensor.

Any of the above methods may further include:

sending control signals from the controller to retract all of the suspension actuators and thereby raising the entire bottom pan assembly at least in part in response to the signal from the swelling sensor.

Any of the above methods may further include:

sending control signals from the controller to retract all of the suspension actuators to raise the bottom pan assembly to a transport position.

Numerous objects, features and advantages of the present invention will be readily apparent to those skilled in the art upon a review of following description in conjunction with the accompanying drawings.

BRIEF DESCRIPTION OF THE DRAWINGS

FIG. 12A shows the position of the dowel bar inserter closest to the concrete mold and FIG. 12B shows the position of the dowel bar inserter furthest from the concrete mold.

DETAILED DESCRIPTION

The embodiments of the present disclosure described below are not intended to be exhaustive or to limit the disclosure to the precise forms disclosed in the following detailed description. Rather, the embodiments are chosen and described so that others skilled in the art may appreciate and understand the principles and practices of the present disclosure.

Figure 1:
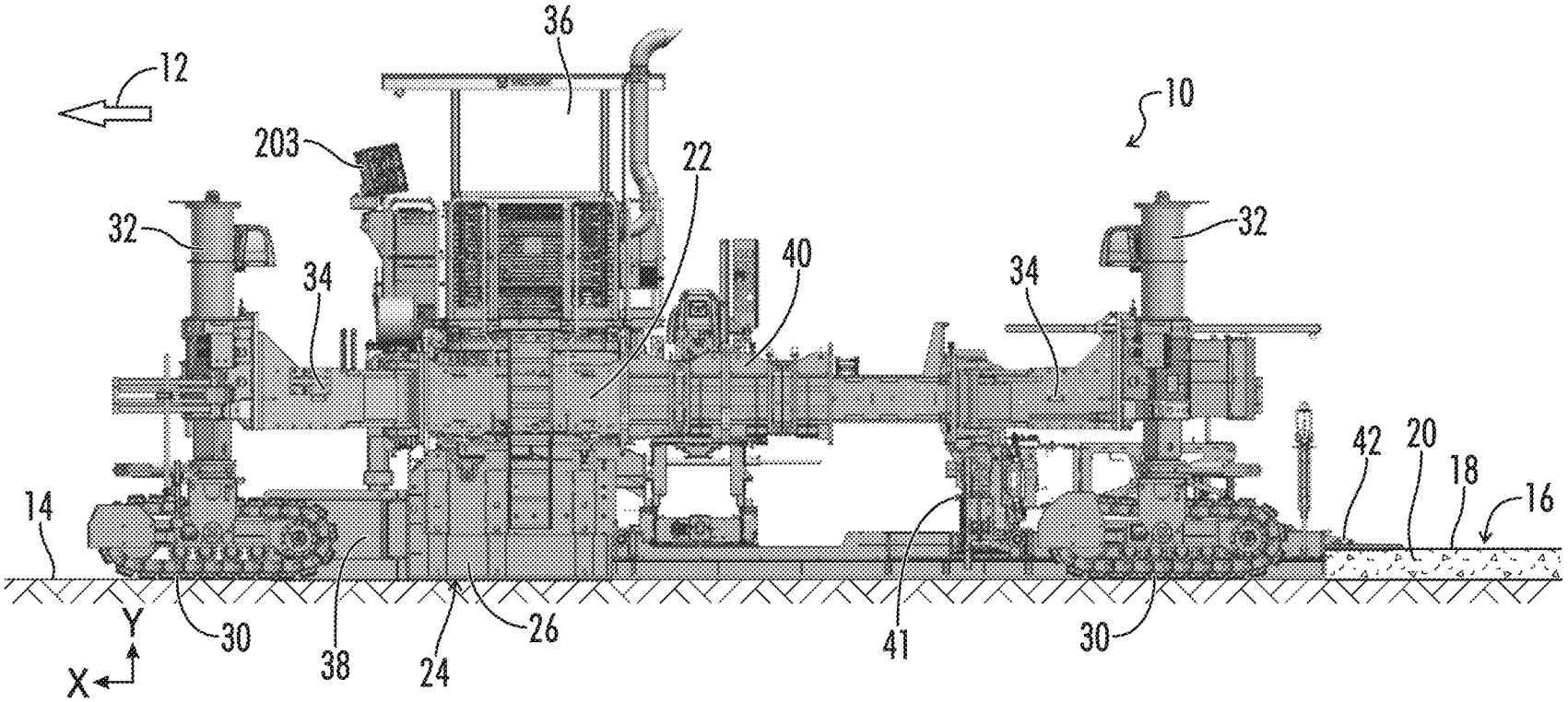
FIG. 1 is a side elevation view of a slip form paver including a dowel bar inserter.

Referring now to the drawings and particularly to FIG. 1 a slip form paver apparatus is shown and generally designated by the number 10. The apparatus 10 is configured to move in a paving direction 12 across a ground surface 14 for spreading, leveling and finishing concrete into a finished concrete structure 16 having a generally upwardly exposed concrete surface 18 and terminating in lateral concrete sides such as 20.

The slip form paver apparatus 10 includes a main frame 22 and a slip form paver mold 24 supported from the main frame 22. Left and right side form assemblies 26 are connected to the slip form paver mold 24 to close the slip form paver mold 24 on the left and right sides to form the lateral concrete sides such as 20 of the finished concrete structure 16. The slip form paver apparatus 10 shown in FIG. 1 is an inset type slip form paver apparatus.

The main frame 22 is supported from the ground surface by a plurality of ground engaging units such as 30, which in the illustrated embodiment are tracked ground engaging units 30. Wheeled ground engaging units may also be used. Each of the ground engaging units 30 is connected to the main frame 22 by a lifting column such as 32 which is attached to a swing arm such as 34. An operator's station 36 is located on the main frame 22. A plow or spreader device 38 is supported from the main frame 22 ahead of the slip form paver mold 24. Behind the slip form paver mold 24 a dowel bar inserter apparatus 40 may be provided. Behind the dowel bar inserter apparatus 40 an oscillating beam 41 and a super smoother apparatus 42 may be provided.

Figure 2:
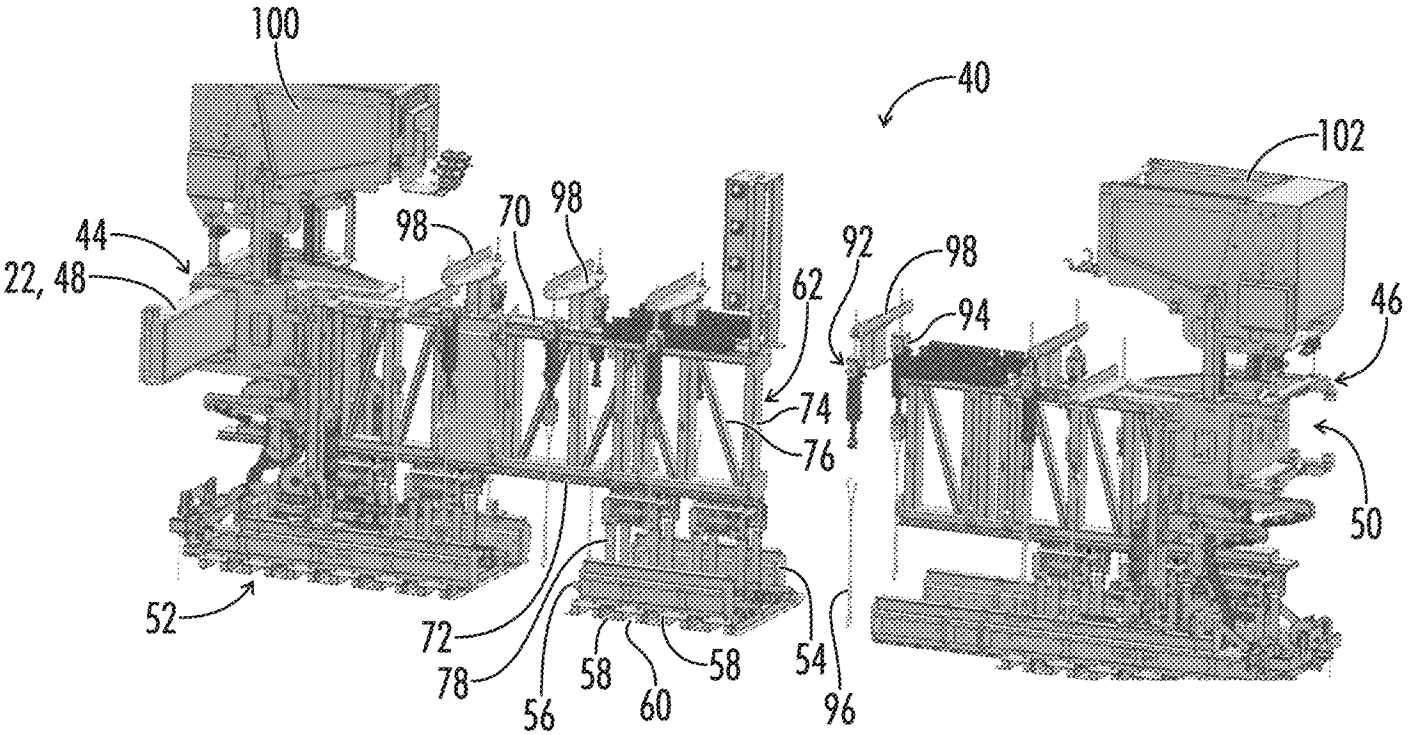
FIG. 2 is right rear perspective view of a dowel bar inserter shown in partially exploded and partially sectioned form.
Figure 3:
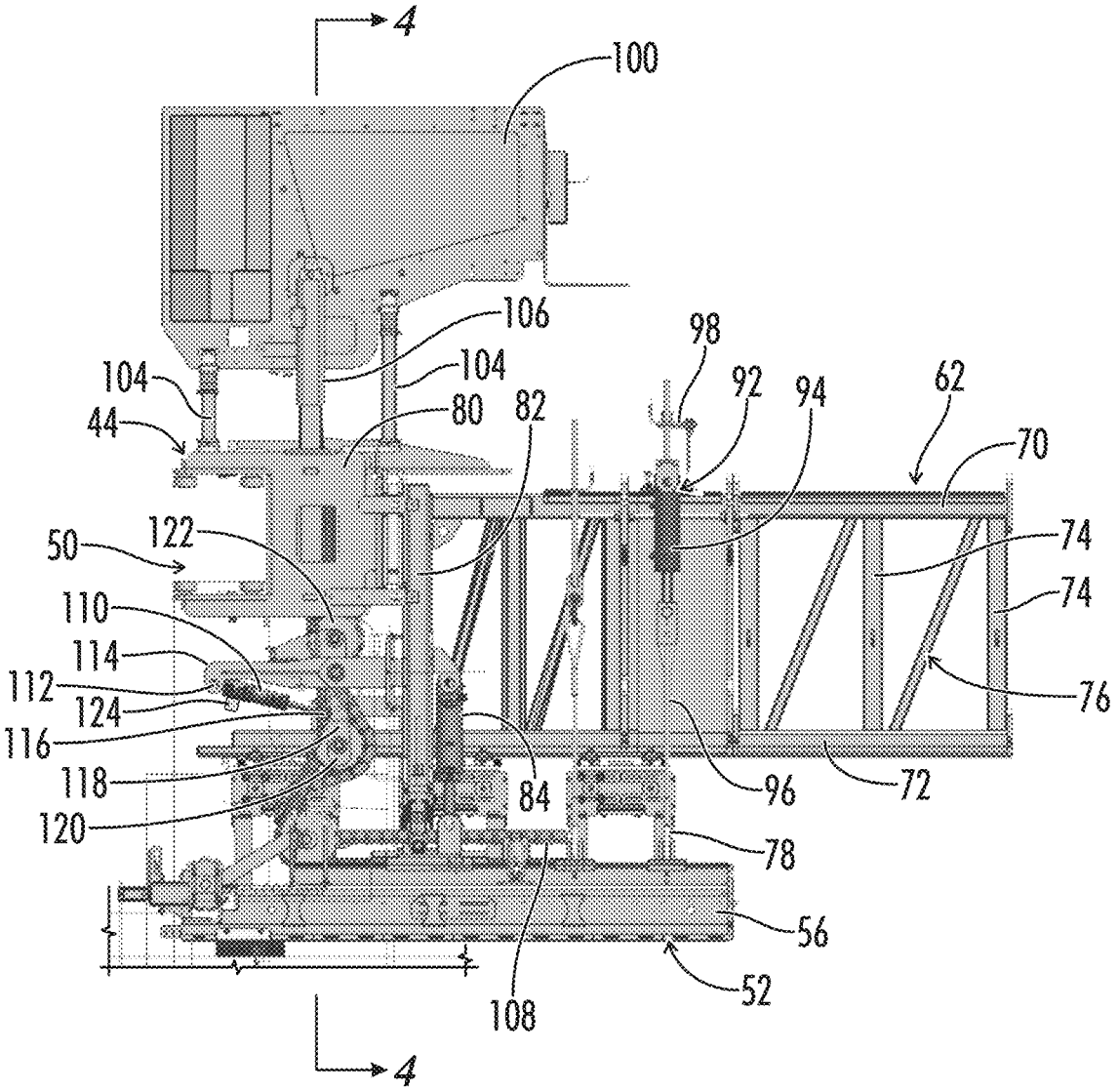
FIG. 3 is an enlarged rear elevation view of the left end portion of the dowel bar inserter of FIG. 2.

The present disclosure is focused on the construction of the dowel bar inserter 40. FIG. 2 shows a partially sectioned rear perspective view, and FIG. 3 shows an enlarged rear elevation view of the left end portion of the dowel bar inserter 40. The dowel bar inserter 40 is an apparatus for inserting short lengths of reinforcing bar, referred to as dowel bars 79 (see FIGS. 9 and 10), into the freshly poured concrete slab 16.

The dowel bar inserter 40 includes first and second end carriages 44 and 46. As can be seen in FIG. 2 the first or left end carriage 44 is shown in place on a lengthwise rail 48 which may be a part of the main frame 22 of the slip form paver 10, or which may be a separate rail attached to the rear of the main frame 22. The corresponding rail on the right side for the second or right end carriage 46 is not shown so that the construction of the second end carriage 46 may be seen. The end carriages each include a C-shape lateral opening such as 50 which is received on the respective rail such as 48 so that the dowel bar inserter 40 may move forward and backward relative to the main frame 22 during the dowel bar insertion operation.

The dowel bar inserter 40 includes bottom pan assembly 52 which slides across the top surface 18 of the concrete slab 16 during the paving operation. The bottom pan assembly 52 includes a forward pan beam 54, a rearward pan beam 56, and a series of pan sections 58 attached to the pan beams and having spaces 60 between adjacent pan sections. Alternatively, the pan section 58 may extend in one or more segments across the width of the dowel bar inserter 40 and the spaces 60 may be formed in the pan section 58 itself. As further described below the dowel bars are pushed downward through the spaces 60 into the freshly poured concrete slab 16.

As will be understood by those skilled in the art the dowel bar inserter 40 slides forward and backward on the rails 48 during the dowel bar insertion operation. The slip form paver 10 moves forward continuously. When the dowel bar inserter 40 reaches a location where a group of dowel bars 79 are to be inserted the dowel bar inserter 40 is held stationary relative to the ground surface 14 and the slab 16 while the slip form paver 10 continues to move forward. This temporary stopping of the dowel bar inserter 40 is achieved by sliding the dowel bar inserter rearward on rails 48 at the same speed at which the slip form paver 10 is advancing. While the dowel bar inserter 40 is stationary over the slab 16 a set of dowel bars is inserted. Then the dowel bar inserter 40 is moved forward on the rails 48 back to its initial forward position and it is ready to perform the next insertion cycle.

Figure 4:
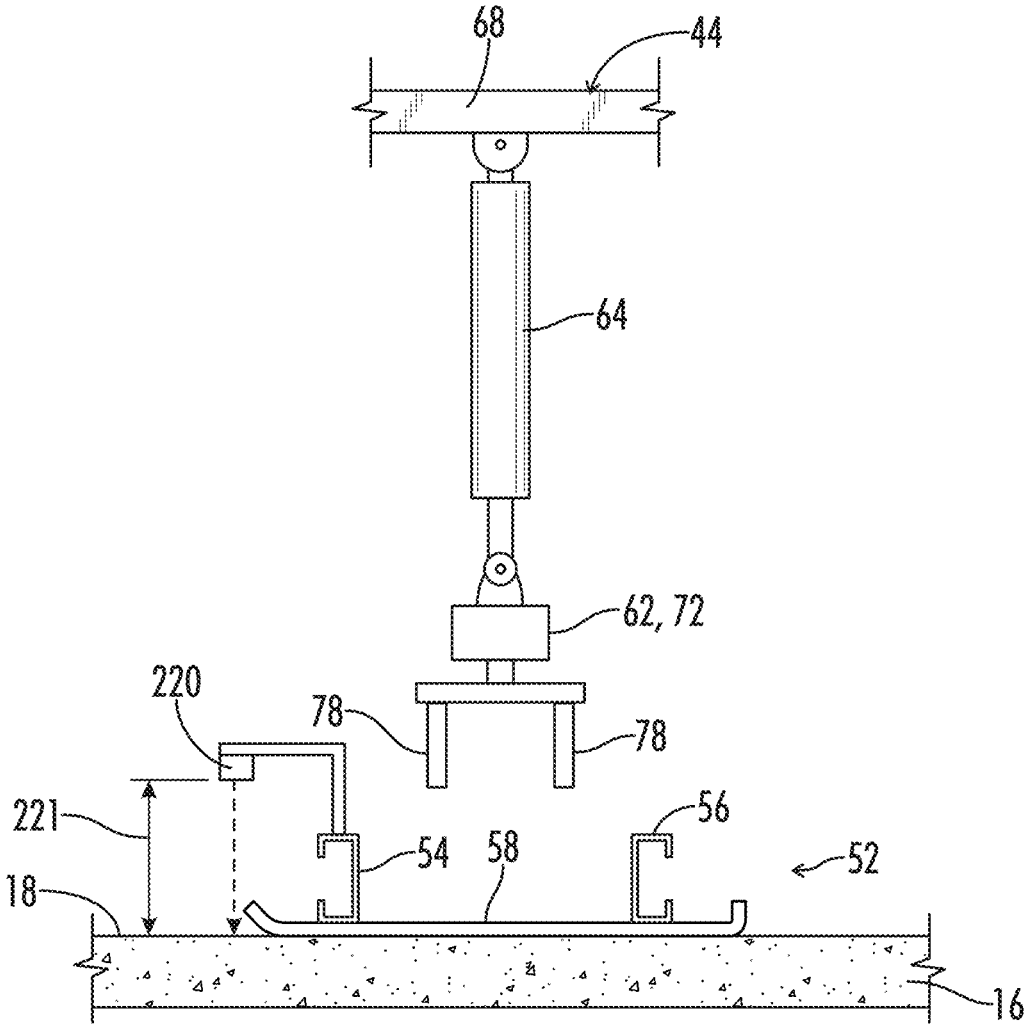
FIG. 4 is a schematic sectioned end elevation view of the dowel bar inserter of FIGS. 2 and 3, taken along line 4-4 of FIG. 3, showing one of the insertion actuators connected between the left end carriage and the insertion beam.

An insertion beam 62 is supported from the left and right end carriages 44, 46, respectively. FIG. 4 is a schematic left end view of the dowel bar inserter 40 taken along line 4-4 of FIG. 3. FIG. 4 shows a portion of the left end carriage 44 with a first insertion actuator 64 having its upper end attached to a cross-beam 68 of left end carriage 44 and having its lower end connected to the insertion beam 62. A similar second insertion actuator 66 is connected between the right end carriage 46 and the insertion beam 62. As can better be seen in FIGS. 2 and 3 the insertion beam 62 is a truss structure including an upper beam channel 70, a lower beam channel 72, a plurality of vertical supports 74 and a plurality of diagonal supports 76 extending between the upper and lower beam channels 70 and 72. The lower ends of the first and second insertion actuators 64 and 66 may be attached to the lower beam channel 72 as seen in FIG. 4.

Figure 9:
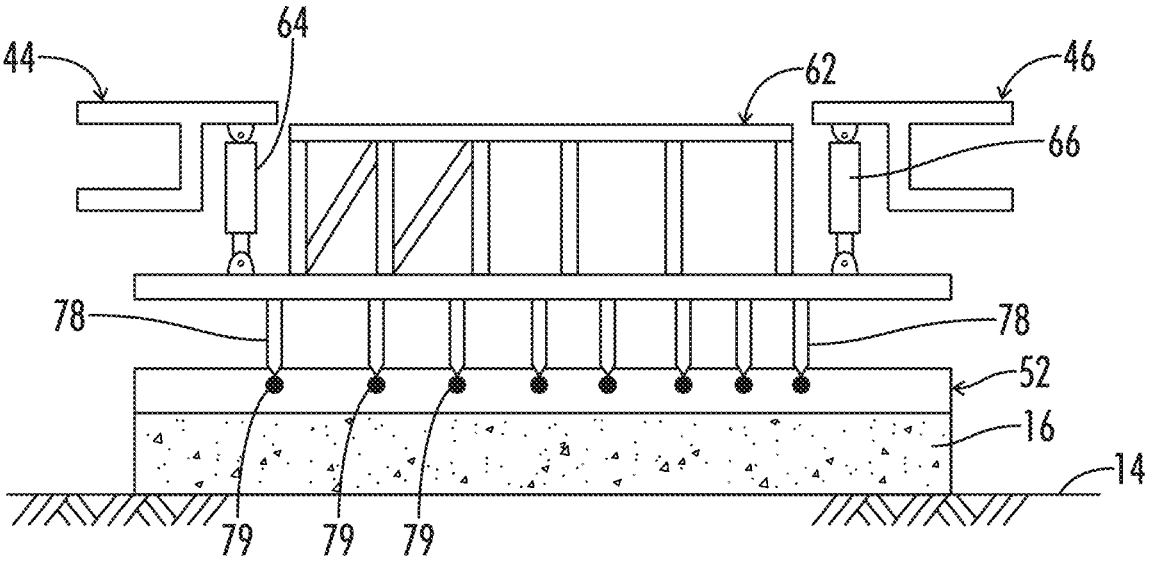
FIG. 9 is a schematic rear elevation view showing the insertion beam in a raised position relative to the bottom pan assembly.
Figure 10:
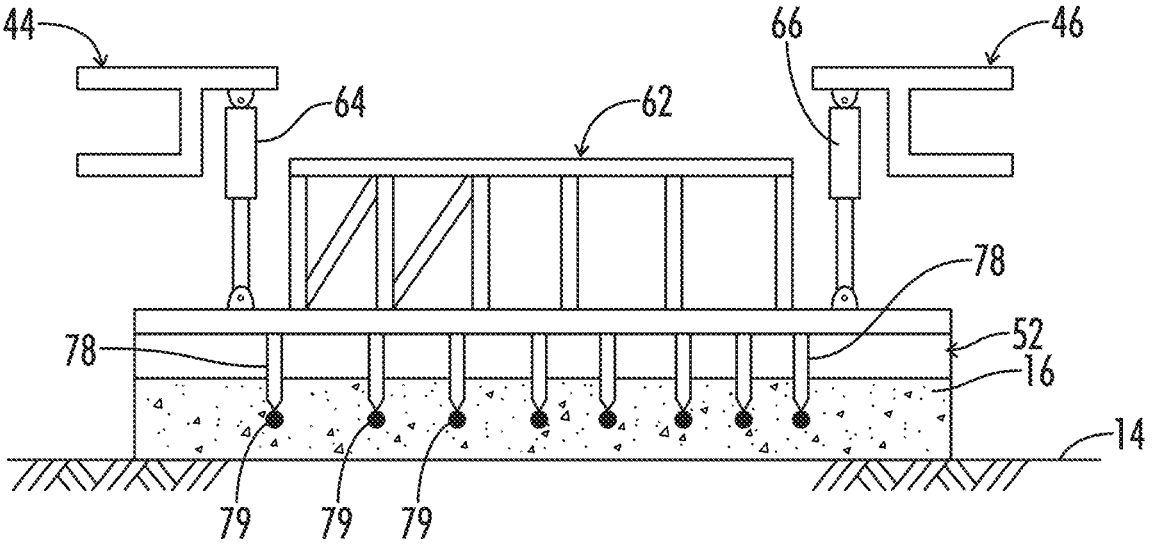
FIG. 10 is a schematic rear elevation view similar to FIG. 9 but showing the insertion beam in a lowered position relative to the bottom pan assembly wherein the dowel bars have been inserted into the freshly poured concrete slab.

A plurality of insertion forks 78 are attached to the insertion beam 62. When the insertion beam 62 is lowered from the position of FIGS. 2-4 relative to the carriages 44, 46 and the bottom pan assembly 52 the insertion forks 78 push the dowel bars through the spaces 60 down into the freshly poured concrete slab 16. Upper and lower positions of the insertion beam 62 are schematically shown in FIGS. 9 and 10. In FIG. 9 the insertion beam 62 is in a raised position relative to bottom pan assembly 52 and the insertion forks 78 are engaged with dowel bars 79 which are being held in the bottom pan assembly 52. In FIG. 10 the insertion beam has been lowered by the insertion actuators 64 and 66 to a lower position relative to the bottom pan assembly 52 wherein the dowel bars 79 have been pushed by the insertion forks 78 down into the freshly poured concrete slab 16.

In an embodiment the first and second insertion actuators 64 and 66 may be hydraulic "smart" cylinders such as are further described below with reference to FIG. 5.

In FIG. 3 the details of construction of the left end carriage 44 can be seen. The right end carriage 46 is a mirror image. Left end carriage 44 includes a main carriage body 80. Front and rear support legs 82 are attached to and extend downward from carriage body 80. The rear support leg 82 is seen in FIG. 3.

Suspension Actuators

The bottom pan assembly 52 is supported from the support legs such as 82 of the left and right end carriages 44, 46 by four suspension actuators 84, 86, 88 and 90. In FIG. 3 the left rear suspension actuator 84 is shown having its upper end connected to the left rear support leg 82 of the left end carriage 44 and having its lower end connected to the left end of the rear pan beam 56 of bottom pan assembly 52. Retraction and extension of the left rear suspension actuator 84 raises and lowers the left rear corner of the bottom pan assembly 52. Similarly, the right rear suspension actuator 86 supports the right end of rear pan beam 56, and the left and right front suspension actuators 88 and 90 support the left and right ends of the front pan beam 54.

In an embodiment each of the suspension actuators 84, 86, 88 and 90 is independently controllable. Thus, all the suspension actuators may be simultaneously or separately retracted or extended. In one embodiment all the suspension actuators may be simultaneously retracted or extended to raise or lower the bottom pan assembly 52. In another embodiment the front suspension actuators 88 and 90 may be raised more than the rear suspension actuators 84 and 86 to adjust a front to rear slope of the bottom pan assembly 52. In a further embodiment the left end suspension actuators 84 and 88 may be extended differently from the right end suspension actuators 86 and 90 to provide a cross slope of the bottom pan assembly 52.

In an embodiment the dowel bar inserter 40 may be described as having at least one first end suspension actuator 84 and/or 88 for supporting the bottom pan assembly 52 from the first end carriage 44 independent of the raising and lowering of the insertion beam 62 relative to the first end carriage 44. Similarly, the dowel bar inserter 40 may be described as having at least one second end suspension actuator 86 and/or 90 for supporting the bottom pan assembly 52 from the second end carriage 46 independent of the raising and lowering of the insertion beam 62 relative to the second end carriage 46.

In an embodiment the suspension actuators 84, 86, 88 and 90 may each have associated therewith a suspension actuator extension sensor 84S, 86S, 88S and 90S, respectively, configured to detect an amount of extension of the respective suspension actuator. In an embodiment each of the suspension actuators may be a hydraulic cylinder. In a further embodiment the hydraulic cylinders may each be a hydraulic smart cylinder and the suspension actuator extension sensors associated with each suspension actuator may be an integral part of the hydraulic smart cylinder, as is further described below with reference to FIG. 5. In a further embodiment the suspension actuator extension sensors may be separate from the associated hydraulic cylinders.

Deflection Compensation Actuators

Due to the substantial width of the bottom pan assembly 52 it may be desirable to provide further support for the weight of the bottom pan assembly 52 in between the left and right end suspension actuators 44 and 46. This further support may be provided by a plurality of deflection compensation actuators 92. In an embodiment as seen in FIGS. 2 and 3 the deflection compensation actuators 92 may be configured to support a plurality of intermediate locations of the bottom pan assembly 52 from the insertion beam 62. In another embodiment the deflection compensation actuators may be configured to support the bottom pan assembly from a truss or other cross-beam support structure 95 extending between the first and second end carriages 44 and 46 as further described below with reference to FIG. 8.

In the embodiment shown in FIGS. 2 and 3 each of the deflection compensation actuators 92 includes a hydraulic cylinder 94 attached to the insertion beam 62 and a flexible connector 96 connecting the hydraulic cylinder 94 to the bottom pan assembly 52. The flexible connector 96 may for example be a length of cable. Due to the presence of the flexible connector 96 the deflection compensation actuators 92 may support the bottom pan assembly 52 in tension loading but the deflection compensation actuators 92 cannot support the bottom pan assembly in compression loading.

In an embodiment each of the hydraulic cylinders 94 may be a hydraulic "smart" cylinder including an integral deflection compensation actuator extension sensor 94S as further described below with regard to FIG. 5. In another embodiment the deflection compensation actuator extension sensors may be separate from the associated hydraulic cylinders.

As best seen in FIG. 2, in an embodiment the deflection compensation actuators 92 may be arranged in pairs, each pair including a front and a rear deflection compensation actuator 92 having its lower end connected to the front pan beam 54 or the rear pan beam 56, respectively. The upper ends of each pair of deflection compensation actuators may be connected to the arms of one of a plurality of T-shaped supports 98 extending upward from the insertion beam 62.

Like the suspension actuators 84, 86, 88 and 90, each of the deflection compensation actuators 92 may be independently controllable. Thus, all of the deflection compensation actuators 92 may be simultaneously retracted or extended in synchronicity with the suspension actuators 84, 86, 88 and 90 to raise or lower the bottom pan assembly 52. Also, the front deflection compensation actuators may be raised more than the rear deflection compensation actuators to adjust a front to rear slope of the bottom pan assembly 52. Further, in rare cases, the front deflection actuators may even be set lower than the rear deflection compensation actuators. And along the length of the dowel bar inserter 40 from left to right the deflection compensation actuators may be extended different distances to provide a cross slope or a crown to the bottom pan assembly 52.

In the embodiment illustrated in FIGS. 2 and 3 the deflection compensation actuators 92 are mounted on the insertion beam 62. Thus, the actuators 92 move up and down with the insertion beam 62 relative to the bottom pan assembly 52. The deflection compensation actuators may control the tension therein when the bottom pan assembly 52 is sliding across the top of the freshly poured concrete. When the bottom pan assembly is held stationary relative to the freshly poured concrete during the insertion process, the bottom pan assembly 52 rests with its entire weight on the concrete as the insertion beam is lowered.

Figure 8:
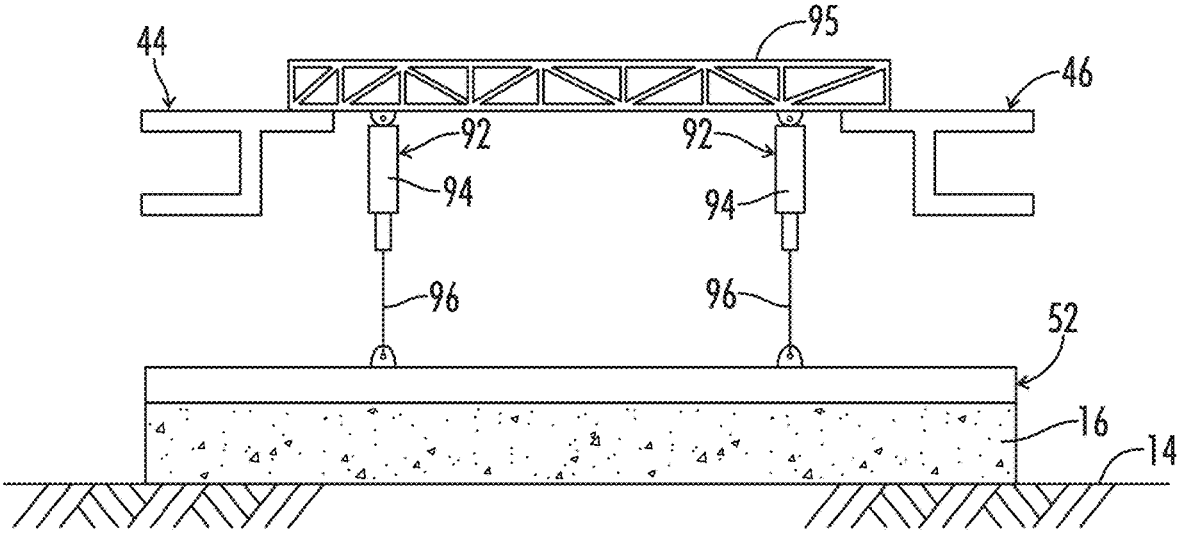
FIG. 8 is a schematic rear elevation of an alternative embodiment of the dowel bar inserter in which the deflection compensation actuators are supported from a truss beam spanning between the two end carriages.

Alternatively, in another embodiment as schematically shown in FIG. 8 the deflection compensation actuators 92 may be supported from a truss beam 95 spanning between the carriages 44 and 46 so that the deflection compensation actuators 92 do not move up and down with the insertion beam 62. In this schematic illustration only two of the deflection compensation actuators 92 are shown. In this case the operator can either maintain supporting tension on the deflection compensation actuators during the insertion step or lower the bottom pan assembly 52 to place its weight on the concrete during the dowel bar insertion step, as desired. Also, especially in cases of the largest paving machines having paving widths over 50 feet, deflection compensation actuators may be supported from both the insertion beam 62 and from the truss beam 95. A further feature that can be provided when the deflection compensation actuators are supported from the truss beam 95 is to lower the entire weight of the bottom pan assembly 52 onto the concrete during the insertion step, and then return the bottom pan assembly 52 to exactly the same height and tension loading after the insertion step.

Dowel Bar Distribution

The dowel bar inserter 40 may include left and right dowel bar storage bins 100 and 102 located above the left and right end carriages 44 and 46, respectively. The details of the left dowel bar storage bin 100 are best shown in FIG. 3. The left dowel bar storage bin 100 is adjustably supported from end carriage 44 on a plurality of telescoping supports 104 and by at least one adjustable height support 106. The adjustable height support 106 may include one or more hydraulic cylinders. A chain conveyor 108 is configured to carry dowel bars from the dowel bar storage bin 100 to the left half of the bottom pan assembly 52. The right dowel bar storage bin 102 similarly provides dowel bars to the right half of the bottom pan assembly 52. Alternatively, a single endless chain conveyor may extend across the entire dowel bar inserter and depending on the direction of travel of the chain conveyor dowels may be fed from either of the storage bins 100 and 102. The details of the dowel bar storage bins and associated chain conveyors may be constructed in accordance with U.S. Pat. No. 6,655,689, which is incorporated herein by reference. The adjustment of the height of the dowel bar storage bin 100 relative to end carriage 44 by the adjustable height support 106 may provide an initial adjustment of a chain length in the chain conveyor 108 to correspond to the width of the dowel bar inserter 40 during setup of the dowel bar inserter 40. This adjustment of chain length also provides an initial tension in the chain conveyor.

A hydraulic chain tensioning cylinder 110 may have one end 112 pivotally connected to a support arm 114 attached to the end carriage 44. A second end 116 of the hydraulic chain tensioning cylinder 110 may be connected to a pivotable arm 118 carrying sprockets 120 and 122 which apply tension to the chain conveyor 108. The hydraulic chain tensioning cylinder 110 may be configured to provide a further adjustment of chain tension in the chain conveyor 108 during operation of the dowel bar inserter 40.

In an embodiment there may be a front and a rear chain conveyor 108 and a front and a rear chain conveyor hydraulic chain tensioning cylinder 110 associated with the dowel bar storage bin 100.

The chain tensioning cylinders 110 may each be described as a chain tensioning actuator 110 configured to maintain a tension in the chain conveyor 108.

The chain conveyor 108 may have associated therewith a chain tensioning sensor 124 configured to detect a tension in the chain conveyor 108. In one embodiment the chain tensioning sensor 124 may be a pressure sensor associated with the chain tensioning cylinder 110 to detect a hydraulic pressure within the hydraulic cylinder 110 as seen in FIG. 3. In another embodiment the chain tensioning sensor may be a strain gauge mounted on the pivotable arm 118 or some other part of the supporting structure which holds the chain conveyor 108.

In an embodiment each of the hydraulic cylinders 110 may be a hydraulic "smart" cylinder including an integral extension sensor 1105 as further described below with regard to FIG. 5. In another embodiment the hydraulic cylinders 110 may be conventional "dumb" hydraulic cylinders which do not include any extension sensor.

Crown Adjustment Actuators

Figure 6:
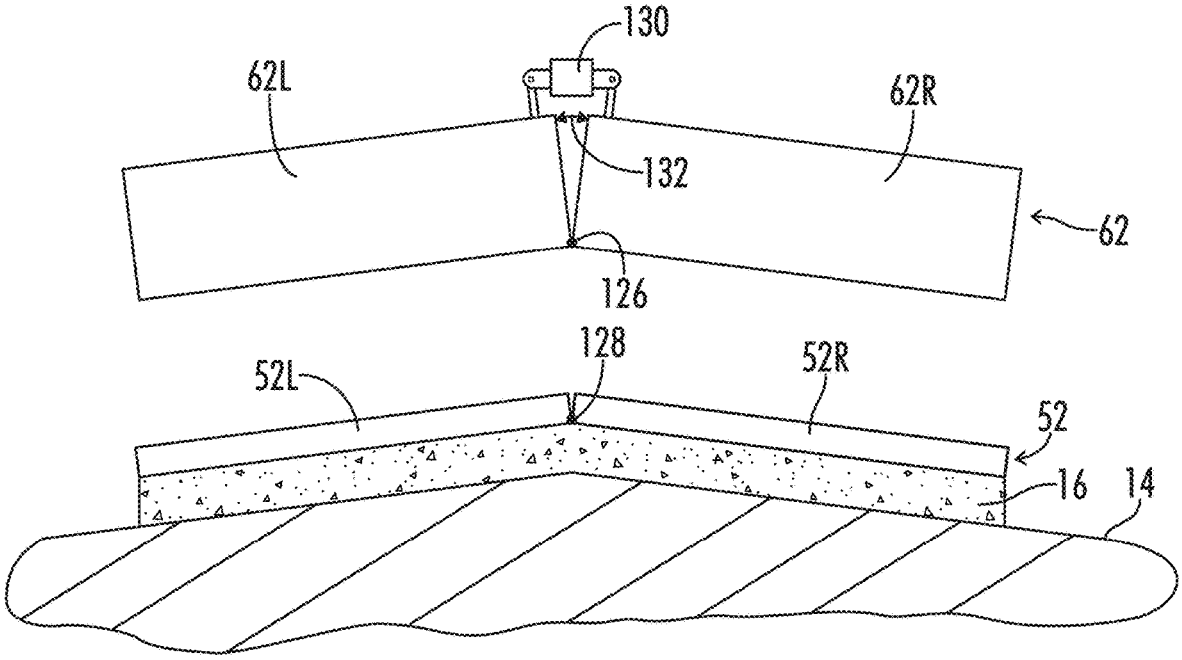
FIG. 6 is a schematic rear elevation view of an embodiment of a dowel bar inserter including a crown actuator.

As is schematically shown in FIG. 6 the insertion beam 62 may include left and right insertion beam portions 62L and 62R pivotally connected at an upper pivot joint 126 and the bottom pan assembly 52 may include left and right bottom pan assembly portions 52L and 52R pivotally connected together at a lower pivot joint 128. One or more crown adjustment actuators 130 may extend between the left and right insertion beam portions 62L and 62R to adjust a crown angle 132 of the dowel bar inserter 40.

In an embodiment the crown adjustment actuator 130 may be a hydraulic cylinder. In another embodiment the hydraulic cylinder 130 may be a hydraulic smart cylinder 130 having an integral hydraulic cylinder extension sensor 130S associated therewith as further described below with reference to FIG. 5. In still another embodiment the extension sensor 130S may be separate from the hydraulic cylinder 130.

Hydraulic "Smart" Cylinders

As previously noted, the first and second insertion actuators 64 and 66, the suspension actuators 84, 86, 88 and 90, the hydraulic cylinders 94 of the deflection compensation actuators 92, the hydraulic chain tensioning cylinders 110 and the crown actuators 130 may be "smart" hydraulic cylinders having integral extension sensors associated therewith. In the control system schematic of FIG. 7 the integral sensor associated with each such smart cylinder is designated by the same numeral as the hydraulic cylinder with the addition of a suffix "5".

Figure 5:
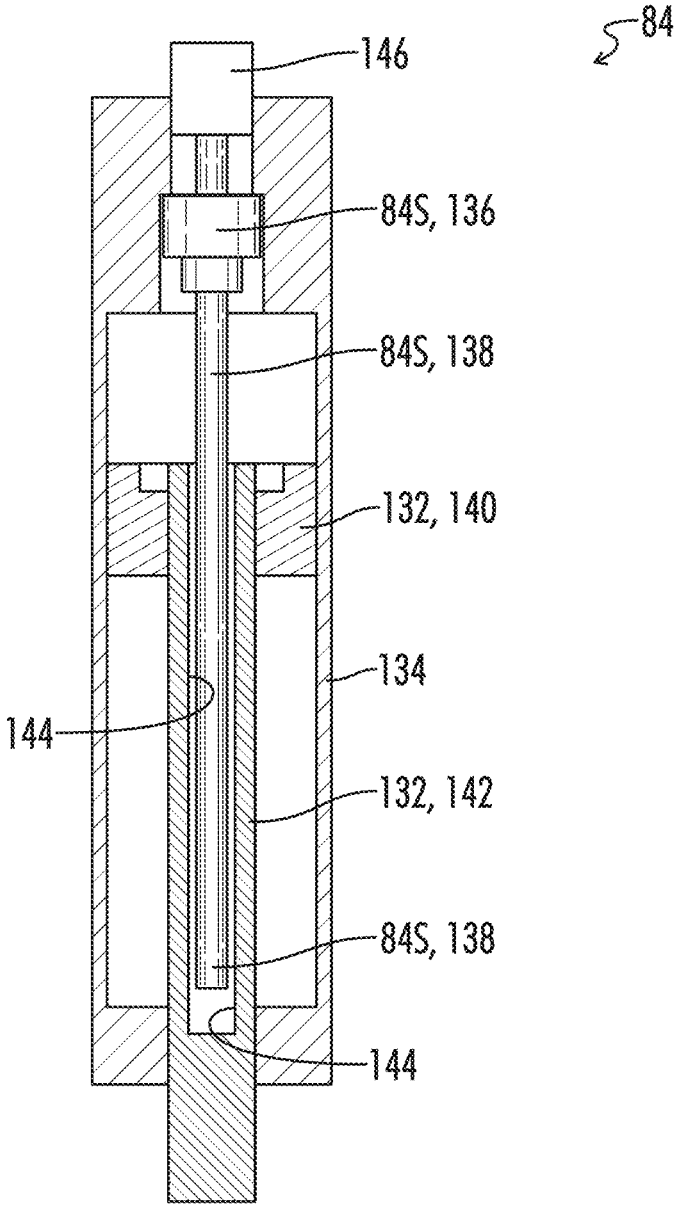
FIG. 5 is a schematic elevation sectioned view of a representative hydraulic "smart" cylinder.

A representative construction of such a "smart" hydraulic cylinder is shown in FIG. 5, and the details of a "smart" hydraulic suspension actuator 84 will be described by way of example. FIG. 5 may also be representative of the internal construction of any of the other actuators herein described when those actuators are implemented as "smart" cylinders. In the illustrated embodiment, the actuator 84 includes an integrated sensor 84S configured to provide a signal corresponding to an extension of a piston member 132 relative to a cylinder member 134 of the actuator 84.

The sensor 84S includes a position sensor electronics housing 136 and a position sensor coil element 138.

The piston portion 132 of actuator 84 includes a piston 140 and a rod 142. The piston 140 and rod 142 have a bore 144 defined therein, within which is received the position sensor coil element 138.

The actuator 84 is constructed such that a signal is provided at connector 146 representative of the position of the piston 140 relative to the position sensor coil element 138.

Such smart cylinders may operate on several different physical principles. Examples of such smart cylinders include but are not limited to magneto-strictive sensing, magneto-resistive sensing, resistive (potentiometric) sensing, Hall effect sensing, sensing using linear variable differential transformers, and sensing using linear variable inductance transducers.

Control System

Figure 7:
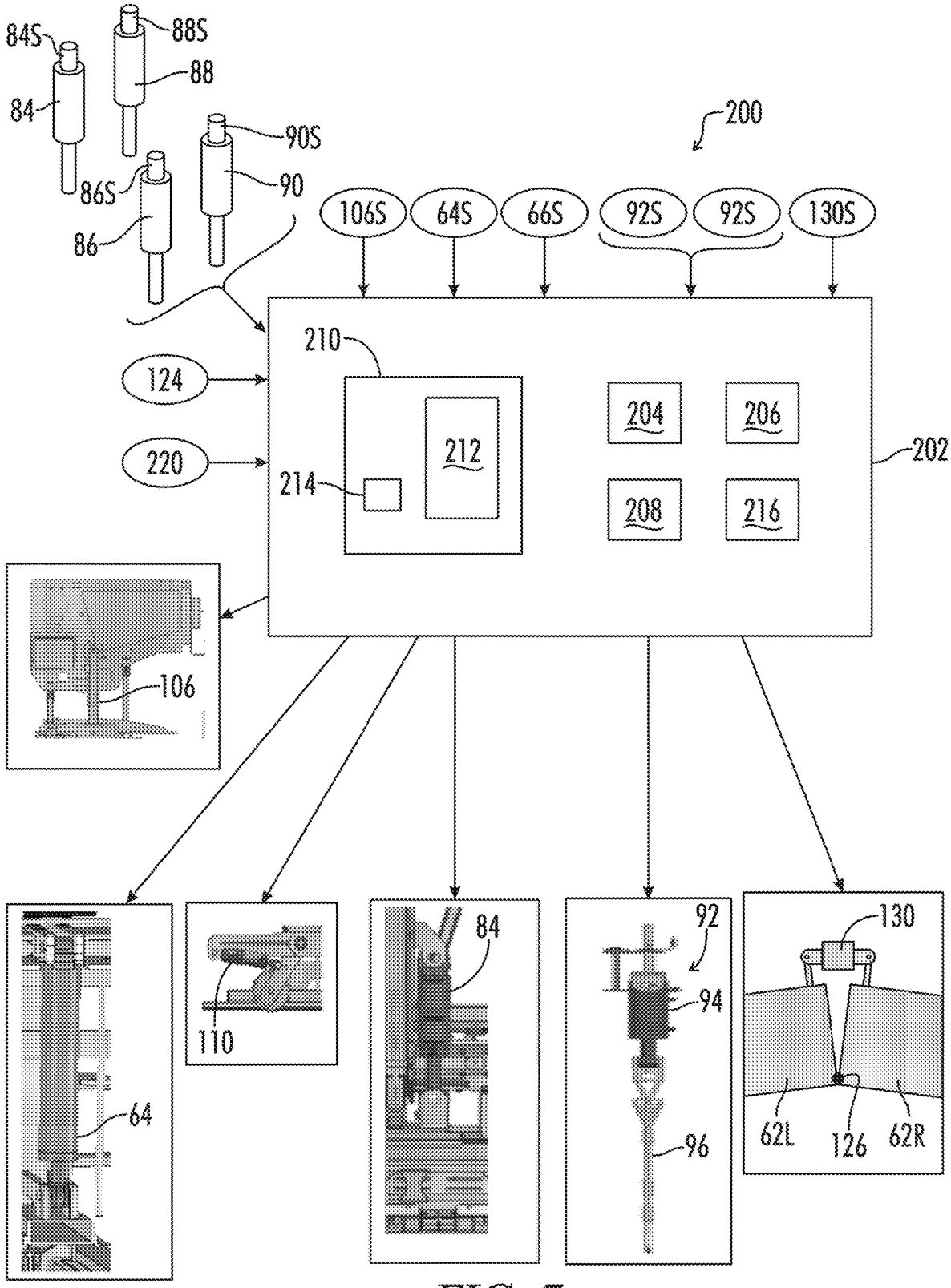
FIG. 7 is a schematic illustration of the controller of the dowel bar inserter of FIG. 2 showing the various sensor inputs to the controller and the various command signal outputs from the controller to the various actuators of the dowel bar inserter.

As schematically illustrated in FIG. 7, the dowel bar inserter apparatus 40 includes a control system 200 including a controller 202. The controller 202 may be part of the machine control system of the slip form paver 10, or it may be a separate control module. The controller 202 may for example be mounted in a control panel 203 located at the operator's station 36. The controller 202 is configured to receive input signals from the various sensors. The signals transmitted from the various sensors to the controller 202 are schematically indicated in FIG. 7 by lines connecting the sensors to the controller with an arrowhead indicating the flow of the signal from the sensor to the controller 202.

For example, extension signals from the extension sensors such as 84S will be received so that the controller can monitor the extension of the suspension actuators such as 84.

Similarly, the controller 202 will generate control signals for controlling the operation of the various actuators discussed above, which control signals are indicated schematically in FIG. 7 by lines connecting the controller 202 to graphic depictions of the various actuators with the arrow indicating the flow of the command signal from the controller 202 to the respective actuators. It will be understood that for control of a hydraulic cylinder type actuator the controller 202 will send an electrical signal to an electro/mechanical control valve (not shown) which controls flow of hydraulic fluid to and from the hydraulic cylinder.

In FIG. 7, for ease of illustration, only the actuators for the left hand side of the dowel bar inserter 40, and the centrally located crown actuator 130 are shown, it being understood that the actuators for the right hand side of the dowel bar inserter 40 are identical to those of the left hand side. Thus FIG. 7 schematically shows the adjustable height support actuator 106, the left insertion actuator 64, the left hydraulic chain tensioning cylinder 110, the left rear suspension actuator 84, one of the deflection compensation actuators 92, and the crown actuator 130.

Controller 202 includes or may be associated with a processor 204, a computer readable medium 206, a data base 208 and an input/output module or control panel 210 having a display 212. An input/output device 214, such as a keyboard, joystick or other user interface, is provided so that the human operator may input instructions to the controller. It is understood that the controller 202 described herein may be a single controller having all of the described functionality, or it may include multiple controllers wherein the described functionality is distributed among the multiple controllers.

Various operations, steps or algorithms as described in connection with the controller 202 can be embodied directly in hardware, in a computer program product 216 such as a software module executed by the processor 204, or in a combination of the two. The computer program product 216 can reside in RAM memory, flash memory, ROM memory, EPROM memory, EEPROM memory, registers, hard disk, a removable disk, or any other form of computer-readable medium 206 known in the art. An exemplary computer-readable medium 206 can be coupled to the processor 204 such that the processor can read information from, and write information to, the memory/storage medium. In the alternative, the medium can be integral to the processor. The processor and the medium can reside in an application specific integrated circuit (ASIC). The ASIC can reside in a user terminal. In the alternative, the processor and the medium can reside as discrete components in a user terminal.

The term "processor" as used herein may refer to at least general-purpose or specific-purpose processing devices and/or logic as may be understood by one of skill in the art, including but not limited to a microprocessor, a microcontroller, a state machine, and the like. A processor can also be implemented as a combination of computing devices, e.g., a combination of a DSP and a microprocessor, a plurality of microprocessors, one or more microprocessors in conjunction with a DSP core, or any other such configuration.

Particularly the controller 202 may be programmed to receive extension signals from each of the extension sensors of the various hydraulic smart cylinders and to send control signals to control the extension of those hydraulic smart cylinders at least in part in response to the respective extension signals.

In one embodiment each of the suspension actuator extension sensors 84S, 86S, 88S and 90S may be configured to generate a suspension actuator extension signal corresponding to the amount of extension of the respective suspension actuator. And the controller 202 may be configured to receive the suspension actuator extension signals to send control signals to the respective suspension actuators, at least in part in response to the suspension actuator extension signals for the respective suspension actuators.

In a further embodiment the controller 202 may be configured to adjust the amount of extension of the forward suspension actuators 88 and 90 relative to the amount of extension of the rear suspension actuators 84 and 86 to adjust a front to rear slope of the bottom pan assembly 52. As will be understood by those skilled in the art the forward edge of the bottom pan assembly is typically held slightly higher that the rear edge so as to prevent the accumulation of a ridge of concrete material in front of the bottom pan assembly 52 as the bottom pan assembly slides forward over the surface 18 of the freshly formed concrete slab 16.

Another phenomenon which must be dealt with when operating a slip form paver 10 including a dowel bar inserter 40 is that of swelling of the concrete layer 16 behind the slip form paver mold 24 and ahead of the bottom pan assembly 52. In a further embodiment a swelling sensor 220 may be provided to detect such swelling. The swelling sensor 220 generates a swelling signal which is received by the controller 202. The controller 202, in response to the swelling signal, may send control signals to all of the suspension actuators 84, 86, 88 and 90 to raise the entire bottom pan assembly 52 and/or to adjust the front to rear slope of the bottom pan assembly 52 so as to accommodate the detected swelling. The control signals are at least in part in response to the signal from the swelling sensor 220.

In one embodiment if a relative small amount of swelling is detected the swelling may be accommodated by an adjustment of the front to rear slope of the bottom pan assembly 52, but if a relatively large amount of swelling is detected the swelling may be accommodated by raising the entire bottom pan assembly 52 in addition to possibly adjusting the front to rear slope of the bottom pan assembly 52.

In one embodiment schematically shown in FIG. 4 the swelling sensor 220 may be a contactless distance sensor such as an ultrasonic sensor or a laser sensor supported from the bottom pan assembly 52 and directed toward the surface 18 of the concrete slab 16 ahead of the bottom pan assembly 52 to measure a vertical distance 221 from a fixed location on the bottom pan assembly to the surface 18. If the slab 16 ahead of the bottom pan assembly 52 begins to swell the distance measured by the swelling sensor 220 will decrease and corrective action can be taken to raise the bottom pan assembly 52 and/or to raise the forward edge of the bottom pan assembly 52 to increase the front to rear slope.

Figure 12A:
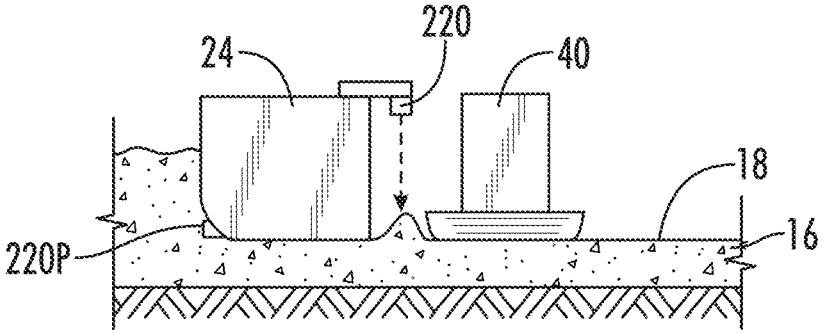
FIGS. 12A and 12B are schematic drawings illustrating the concept of "swelling" of the concrete slab.
Figure 12B:
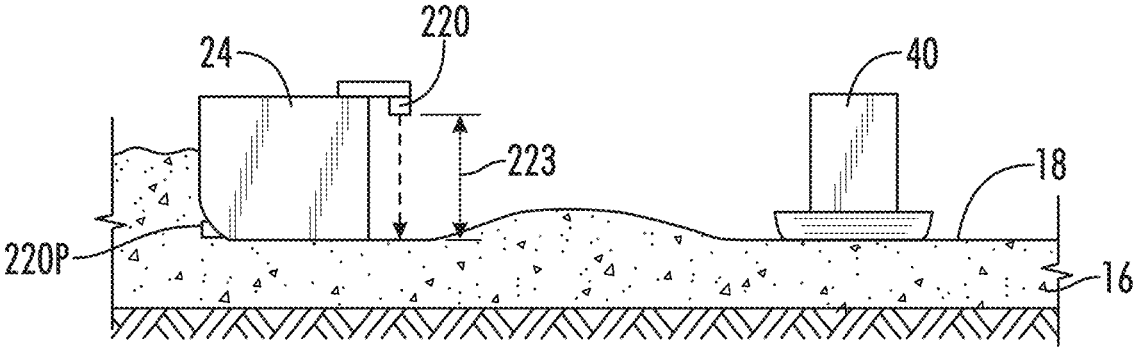

In another embodiment as seen in FIGS. 12A and 12B the swelling sensor 220 may be a contactless distance sensor such as an ultrasonic sensor or a laser sensor supported from the slip form paver mold 24 and directed toward the surface 18 of the concrete slab 16 behind of the slip form paver mold 24 to measure a vertical distance 223 from a fixed location on the mold 24 to the surface 18. FIGS. 12A and 12B schematically show the relative positions of the slip form paver mold 24 and the dowel bar inserter 40 in the forwardmost relative position of the dowel bar inserter 40 (when the insertion step begins) and the rearwardmost position of the dowel bar inserter 40 (when the insertion step ends), respectively. As previously noted, the dowel bar inserter 40 slides forward and backward relative to slip form paver mold 24 on the rails 48 during the dowel bar insertion operation. As schematically shown in FIGS. 12A and 12B the swelling sensor 220 mounted on the slip form paver mold 24 can monitor the extent of concrete swelling as the slip form paver mold 24 moves ahead relative to the dowel bar inserter 40, and then as the dowel bar inserter 40 moves forward over the swollen concrete the controller 202 can make appropriate adjustments in the suspension actuators 84, 86, 88 and 90 and the deflection compensation actuators 92 to accommodate the swelling.

Although only a single swelling sensor 220 is shown in the schematic illustrations, it will be understood that multiple swelling sensors 220 may be placed across the width of the slip form paver apparatus 10. The concrete swelling may not be uniform across the width of the concrete slab and thus it may be desirable to make variable adjustments in the deflection compensation actuators 92 across the width of the concrete slab. Also, it will be understood that in rare cases the "swelling" of the concrete slab may even be negative, that is the concrete slab may shrink, and that also can be accommodated by the systems described above.

A still further alternative type of swelling sensor 220 may be a pressure sensor 220P placed in the concrete near the bottom of the concrete mold 24 at its forward edge as schematically illustrated in FIGS. 12A and 12B. As will be understood by those skilled in the art there are vibrators (not shown) placed in the concrete mass just ahead of the slip form paver mold 24, and due to vibration the mass of concrete is significantly liquified and behaves in large part like a liquid. The higher the pressure in this liquified concrete as the slip form paver mold 24 slides over it, the more likely there is to be swelling of the concrete after the mold 24 passes over the concrete. Thus, the measure of pressure in the concrete by pressure sensor 220P may be used as an indicator of expected swelling.

In another embodiment each of the deflection compensation actuators 92 may comprise a hydraulic smart cylinder 94 including an integral deflection compensation actuator extension sensor 92S configured to generate a deflection compensation actuator extension signal corresponding to the amount of extension of the respective deflection compensation actuator 92. The controller 202 may be configured to receive the deflection compensation actuator extension signals from the deflection compensation actuator extension sensors 92S, and to send control signals to hydraulic cylinders 94 of the respective deflection compensation actuators 92, at least in part in response to the deflection compensation actuator extension signals for the respective deflection compensation actuators 92.

In an embodiment the deflection compensation actuators 92 may be adjusted simultaneously with the suspension actuators 84, 86, 88 and 90 to assist in the adjustment of front to rear slope of the bottom pan assembly 52 and/or to assist in height adjustment of the bottom pan assembly 52. Such adjustments of the deflection compensation actuators 92 may be at least in part in response to the signals from the swelling sensor 220 similar to that described above for the suspension actuators.

Figure 11:
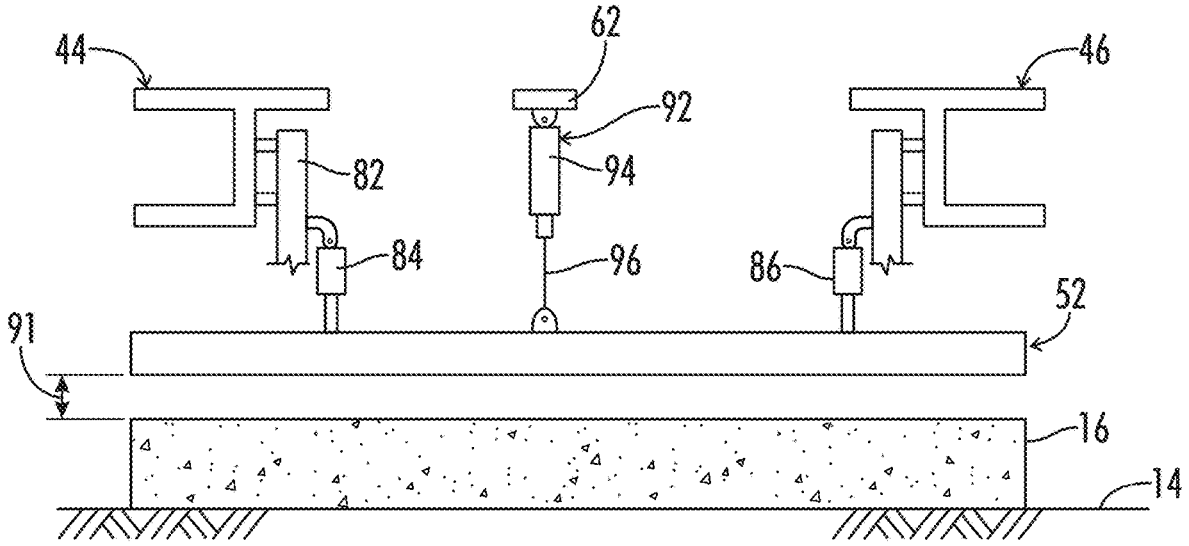
FIG. 11 is a schematic rear elevation view of the bottom pan assembly raised to a transport position so that the bottom pan assembly is spaced above the concrete slab.

In another embodiment the controller 202 may be configured to have a transport mode in which all of the suspension actuators 84, 86, 88 and 90 and all of the deflection compensation actuators 92 are retracted in unison to raise the bottom pan assembly 52 to a transport position in which the bottom pan assembly 52 is located a substantial distance 91 above either the ground surface or the paving slab 16 as necessary. Such a transport position is schematically illustrated in FIG. 11.

Additionally at the end of a paving day the controller 202 may save the extension data for all of the suspension actuators 84, 86, 88 and 90 and for the deflection compensation actuators 92, thereby defining the vertical location of the bottom pan assembly 52 in engagement with the concrete slab 16. Then the bottom pan assembly may be raised above the slab 16 as in the transport mode. Then at the beginning of the next paving day the controller 202 may return the bottom pan assembly 52 to the exact same vertical position to resume paving. Similarly, any of the other actuators having associated extension sensors may be returned to their previous positions after any break in the paving operation.

In another embodiment each of the chain tensioning actuators 110 may have associated therewith a chain tensioning sensor 124. The controller 202 may be configured to receive a chain tensioning signal from the chain tensioning sensor 124 and to send a control signal to the chain tensioning actuator 110, at least in part in response to the chain tension signal. The human operator may input or set a desired chain tension to the controller 202 via the input 214 and the controller 202 may control the chain tension to that set point.

Thus, it is seen that the apparatus and methods of the present disclosure readily achieve the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims Each disclosed feature or embodiment may be combined with any of the other disclosed features or embodiments.

What is claimed is:

1. A dowel bar inserter apparatus for inserting dowel bars in a freshly placed concrete slab, the apparatus comprising:

first and second end carriages;

a bottom pan assembly configured to engage a top surface of the concrete slab;

an insertion beam;

a plurality of insertion forks attached to the insertion beam;

first and second insertion actuators supporting the insertion beam from the first and second end carriages, respectively, for raising and lowering the insertion beam and the insertion forks relative to the end carriages;

at least one first end suspension actuator for supporting the bottom pan assembly from the first end carriage independent of the raising and lowering of the insertion beam relative to the first end carriage;

at least one second end suspension actuator for supporting the bottom pan assembly from the second end carriage independent of the raising and lowering of the insertion beam relative to the second end carriage; and wherein each of the suspension actuators includes associated therewith a suspension actuator extension sensor configured to detect an amount of extension of the respective suspension actuator.

2. The dowel bar inserter apparatus of claim 1, wherein:

the at least one first end suspension actuator includes a forward first end suspension actuator and a rear first end suspension actuator; and the at least one second end suspension actuator includes a forward second end suspension actuator and a rear second end suspension actuator.

3. The dowel bar inserter apparatus of claim 2, wherein:

each of the suspension actuators comprises a hydraulic cylinder.

4. The dowel bar inserter apparatus of claim 2, wherein:

each of the suspension actuators comprises a hydraulic smart cylinder, and the suspension actuator extension sensor associated with each suspension actuator is an integral part of the hydraulic smart cylinder.

5. The dowel bar inserter apparatus of claim 1, further comprising:

a plurality of deflection compensation actuators configured to support a plurality of intermediate locations of the bottom pan assembly, the deflection compensation actuators being located between the first and second suspension actuators.

6. The dowel bar inserter apparatus of claim 5, wherein:

each of the deflection compensation actuators includes a hydraulic cylinder and a flexible connector connecting the hydraulic cylinder to the bottom pan assembly such that the deflection compensation actuators can support the bottom pan assembly in tension loading but not compression loading of the flexible connectors.

7. The dowel bar inserter apparatus of claim 6, wherein:

each of the hydraulic cylinders comprises a hydraulic smart cylinder including an integral deflection compensation actuator extension sensor.

8. The dowel bar inserter apparatus of claim 5, wherein:

each of the deflection compensation actuators is connected to the insertion beam so that the plurality of intermediate locations of the bottom pan assembly are supported from the insertion beam.

9. The dowel bar inserter apparatus of claim 5, wherein:

each of the deflection compensation actuators is connected to a support structure fixed to the first and second end carriages so that the plurality of intermediate locations of the bottom pan assembly are supported from the support structure.

10. The dowel bar inserter apparatus of claim 5, wherein:

the deflection compensation actuators are arranged in pairs of deflection compensation actuators, each pair including a front deflection compensation actuator and a rear deflection compensation actuator.

11. The dowel bar inserter apparatus of claim 1, further comprising:

a chain conveyor configured to carry dowel bars to the bottom pan assembly; and a hydraulic chain tensioning cylinder configured to maintain a tension in the chain conveyor.

12. The dowel bar inserter apparatus of claim 1, wherein:

each of the suspension actuator extension sensors is configured to generate a suspension actuator extension signal corresponding to the amount of extension of the respective suspension actuator; and the apparatus further includes:

a controller configured to receive the suspension actuator extension signals and to send control signals to the respective suspension actuators, at least in part in response to the suspension actuator extension signals for the respective suspension actuators.

13. The dowel bar inserter apparatus of claim 12, further comprising:

a plurality of deflection compensation actuators configured to support a plurality of intermediate locations of the bottom pan assembly from the insertion beam, each of the deflection compensation actuators including a hydraulic smart cylinder including an integral deflection compensation actuator extension sensor; and wherein the controller is further configured to receive deflection compensation actuator extension signals from the deflection compensation actuator extension sensors corresponding to an extension of the respective deflection compensation actuators, and to send control signals to the respective deflection compensation actuators, at least in part in response to the deflection compensation actuator extension signals for the respective deflection compensation actuators.

14. The dowel bar inserter apparatus of claim 1, further comprising:

at least one dowel bar storage bin located above the first end carriage;

a chain conveyor configured to carry dowel bars from the at least one dowel bar storage bin to the bottom pan assembly; and an adjustable height support supporting the at least one dowel bar storage bin at an adjustable height above the first end carriage such that adjustment of the height of the at least one dowel bar storage bin above the first end carriage provides an initial adjustment of a chain length in the chain conveyor during setup of the dowel bar inserter apparatus.

15. The dowel bar inserter apparatus of claim 14, further comprising:

a hydraulic chain tensioning cylinder extending between the first end carriage and the chain conveyor and configured to provide an adjustment of chain tension in the chain conveyor during operation of the dowel bar inserter apparatus.

16. The dowel bar inserter apparatus of claim 1, further comprising:

a chain conveyor configured to carry dowel bars to the bottom pan assembly;

a chain tensioning actuator configured to maintain a tension in the chain conveyor;

a chain tensioning sensor; and a controller configured to:

receive a chain tension signal from the chain tensioning sensor; and send a control signal to the chain tensioning actuator, at least in part in response to the chain tension signal.

17. The dowel bar inserter apparatus of claim 1, wherein:

the at least one first end suspension actuator includes a forward first end suspension actuator and a rear first end suspension actuator; and the at least one second end suspension actuator includes a forward second end suspension actuator and a rear second end suspension actuator;

wherein the dowel bar inserter apparatus further includes a controller configured to adjust the amount of extension of the forward first end suspension actuator and the forward second end suspension actuator relative to the amount of extension of the rear first end suspension actuator and the rear second end suspension actuator, respectively, to adjust a front to rear slope of the bottom pan assembly.

18. The dowel bar inserter apparatus of claim 17, further comprising:

a plurality of deflection compensation actuators configured to support a plurality of intermediate locations of the bottom pan assembly, the deflection compensation actuators being located between the first and second suspension actuators, the deflection compensation actuators being arranged in pairs of deflection compensation actuators, each pair including a front deflection compensation actuator and a rear deflection compensation actuator; and wherein the controller is further configured to adjust an amount of extension of the front deflection compensation actuators relative to an amount of extension of the rear deflection compensation actuators to adjust the front to rear slope of the bottom pan assembly.

19. The dowel bar inserter apparatus of claim 17, further comprising:

a swelling sensor configured to detect a swelling of the concrete slab; and wherein the controller is configured to receive a signal from the swelling sensor corresponding to the swelling of the concrete slab, and to adjust the front to rear slope of the bottom pan assembly at least in part in response to the signal from the swelling sensor.

20. The dowel bar inserter apparatus of claim 19, wherein:

the controller is further configured to adjust all of the suspension actuators to raise the entire bottom pan assembly at least in part in response to the signal from the swelling sensor.

21. The dowel bar inserter apparatus of claim 1, further comprising:

a controller configured to have a transport mode in which all of the suspension actuators are adjusted to raise the bottom pan assembly to a transport position.

22. A method of operating the dowel bar inserter apparatus of claim 1, the method comprising steps of:

receiving suspension actuator extension signals from the suspension actuator extension sensors with a controller; and sending control signals from the controller to the suspension actuators at least in part in response to the suspension actuator extension signals for the respective suspension actuators.

23. The method of claim 22, wherein the apparatus further includes a plurality of deflection compensation actuators configured to support a plurality of intermediate locations of the bottom pan assembly from the insertion beam, each of the deflection compensation actuators including a hydraulic smart cylinder including an integral deflection compensation actuator extension sensor, the method further comprising:

receiving deflection compensation actuator extension signals from the deflection compensation actuator extension sensors corresponding to an extension of the respective deflection compensation actuators; and sending control signals to the respective deflection compensation actuators, at least in part in response to the deflection compensation actuator extension signals for the respective deflection compensation actuators.

24. The method of claim 22, wherein the apparatus further includes a chain conveyor configured to carry dowel bars to the bottom pan assembly, a chain tensioning actuator configured to maintain a tension in the chain conveyor, and a chain tensioning sensor, the method further comprising:

receiving a chain tension signal from the chain tensioning sensor with the controller; and sending a control signal from the controller to the chain tensioning actuator, at least in part in response to the chain tension signal.

25. The method of claim 22, wherein the at least one first end suspension actuator includes a forward first end suspension actuator and a rear first end suspension actuator, and the at least one second end suspension actuator includes a forward second end suspension actuator and a rear second end suspension actuator, the method further comprising:

sending control signals from the controller to adjust the amount of extension of the forward first end suspension actuator and the forward second end suspension actuator relative to the amount of extension of the rear first end suspension actuator and the rear second end suspension actuator, respectively, thereby adjusting a front to rear slope of the bottom pan assembly.

26. The method of claim 25, wherein the apparatus further includes a plurality of deflection compensation actuators configured to support a plurality of intermediate locations of the bottom pan assembly, the deflection compensation actuators being located between the first and second suspension actuators, the deflection compensation actuators being arranged in pairs of deflection compensation actuators, each pair including a front deflection compensation actuator and a rear deflection compensation actuator, the method further comprising:

sending control signals from the controller to adjust an amount of extension of the front deflection compensation actuators relative to an amount of extension of the rear deflection compensation actuators to adjust the front to rear slope of the bottom pan assembly.

27. The method of claim 25, further comprising:

detecting a swelling of the concrete slab with a swelling sensor;

receiving with the controller a signal from the swelling sensor corresponding to the swelling of the concrete slab; and sending control signals from the controller to adjust the front to rear slope of the bottom pan assembly at least in part in response to the signal from the swelling sensor.

28. The method of claim 27, further comprising:

sending control signals from the controller to retract all of the suspension actuators and thereby raising the entire bottom pan assembly at least in part in response to the signal from the swelling sensor.

29. The method of claim 22, further comprising:

sending control signals from the controller to retract all of the suspension actuators to raise the bottom pan assembly to a transport position.

* * * * *